United States Patent [19]

Zientara

[11] 4,369,546

[45] Jan. 25, 1983

[54] HAND HELD TOOLS AND UTENSILS STABILIZER BAR, ADJUSTABLE AND NON-ADJUSTABLE

[76] Inventor: Stanley V. Zientara, 5243 S. Normandy Ave., Chicago, Ill. 60638

[21] Appl. No.: 108,271

[22] Filed: Dec. 28, 1979

[51] Int. Cl.[3] ..... A47B 95/02

[52] U.S. Cl. ..... 16/110 R; 30/381; 239/526

[58] Field of Search ..... 74/557; 16/110 R, 114 R; D23/17; 239/DIG. 14, 526; 30/381, 382

[56] References Cited

U.S. PATENT DOCUMENTS

| | | | |
|---|---|---|---|
| 2,012,637 | 8/1935 | Ribley | 16/110 R |
| 2,091,458 | 8/1937 | Sleight | 16/110 R |
| 2,252,200 | 8/1941 | Plummer | 239/DIG. 14 |
| 2,545,659 | 3/1951 | Ginter | 16/110 R |
| 2,729,116 | 1/1956 | Arnold | 24/557 |
| 3,949,817 | 4/1976 | Rice | 16/114 R |

FOREIGN PATENT DOCUMENTS

| | | | |
|---|---|---|---|
| 1928171 | 12/1970 | Fed. Rep. of Germany | 16/110 |

*Primary Examiner*—Andrew V. Kundrat

*Attorney, Agent, or Firm*—Wegner, McCord, Wood & Dalton

[57] ABSTRACT

A stabilizer bar for a hand held tool which extends laterally from the handle of the tool to receive and mate with the thumb to stabilize the hand grip of the tool. The stabilizer bar may be cylindrical and eccentrically adjustable to adjust to the comfort of the user's hand or may be provided with an elliptical body likewise adjustable for comfort. Furthermore, the stabilizer bar may be slidable through the handle of the tool to accommodate right or left handed grips.

15 Claims, 29 Drawing Figures

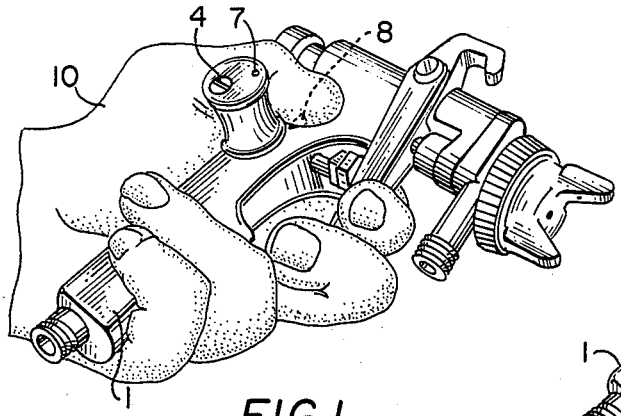
FIG. 1
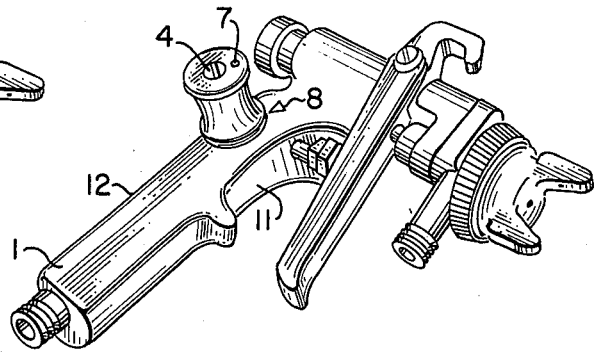
FIG. 2
FIG. 3
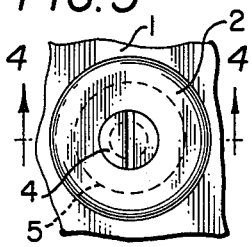
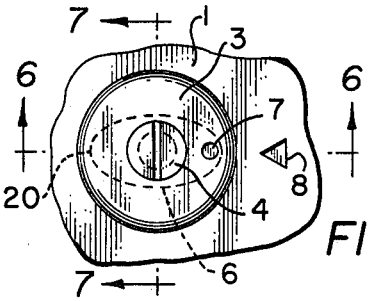
FIG. 5
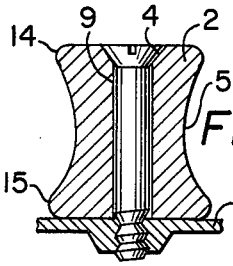
FIG. 4
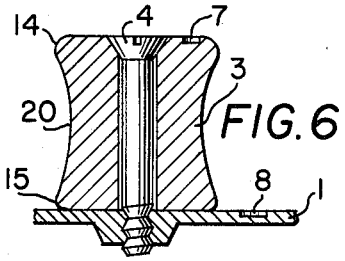
FIG. 6
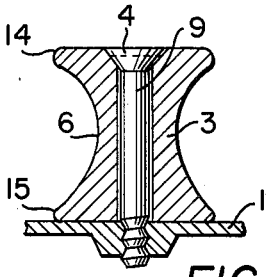
FIG. 7
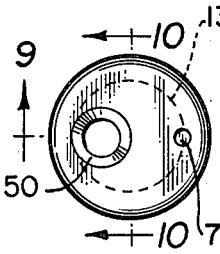
FIG. 8
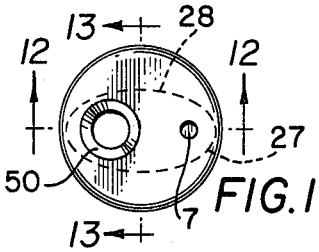
FIG. 11
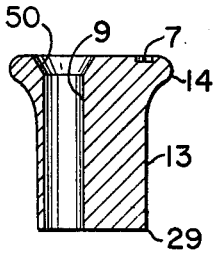
FIG. 9
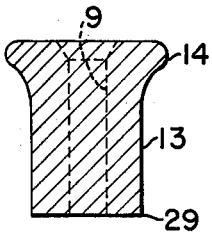
FIG. 10
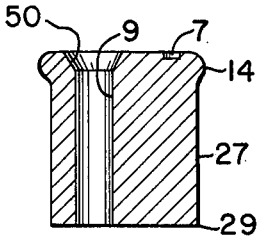
FIG. 12
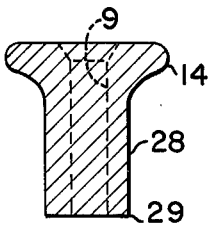
FIG. 13

FIG. 14
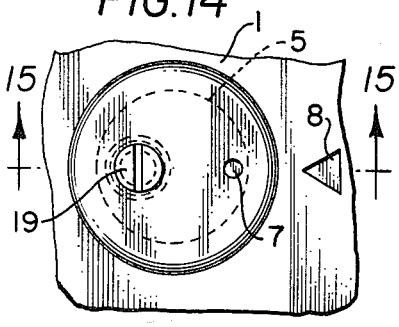
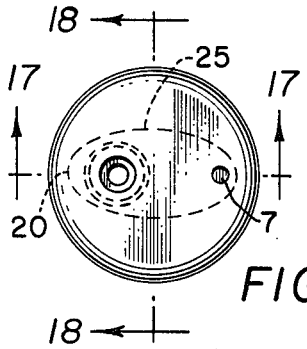
FIG. 16
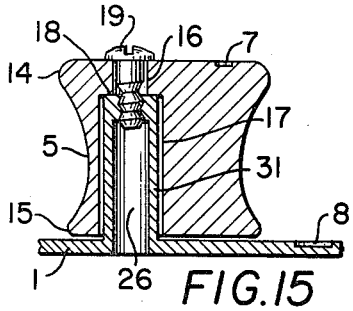
FIG. 15
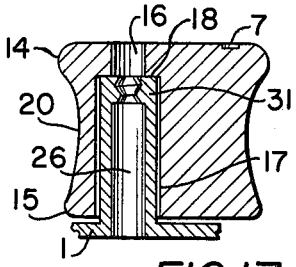
FIG. 17
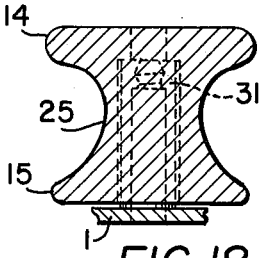
FIG. 18
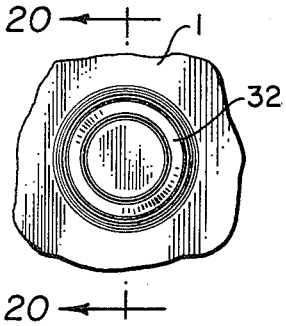
FIG. 19
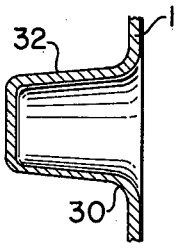
FIG. 20
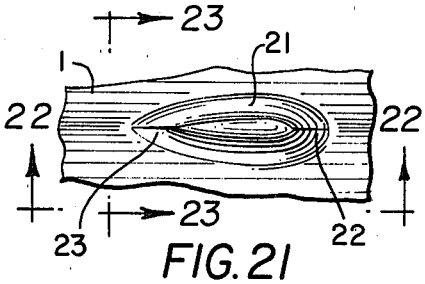
FIG. 21
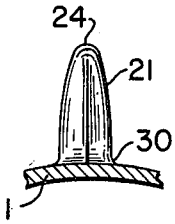
FIG. 23
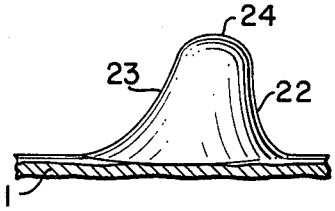
FIG. 22

FIG. 24
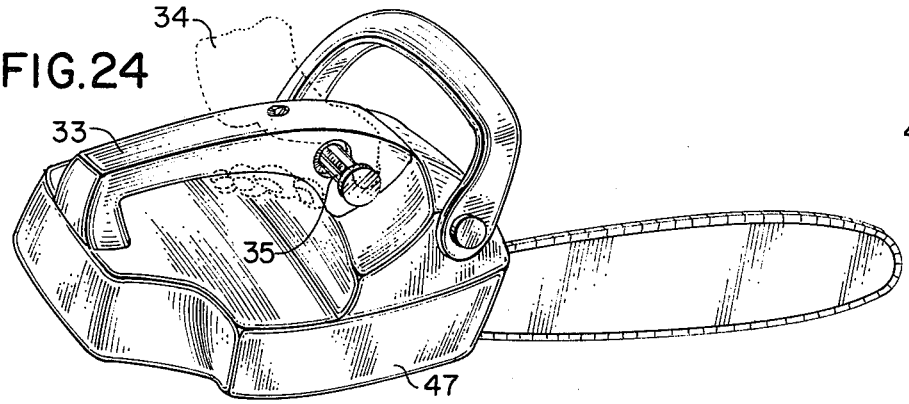
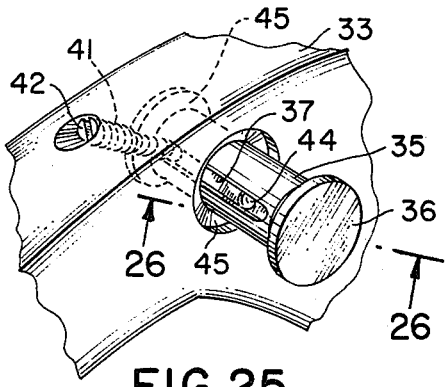
FIG. 25
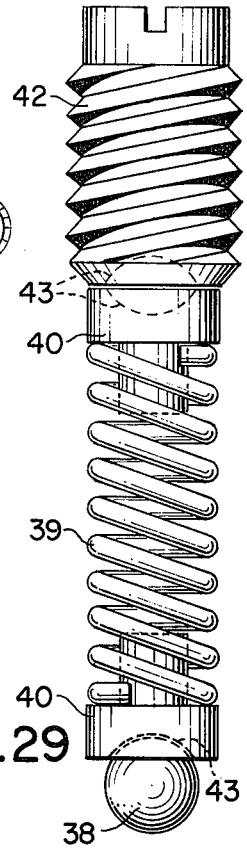
FIG. 29
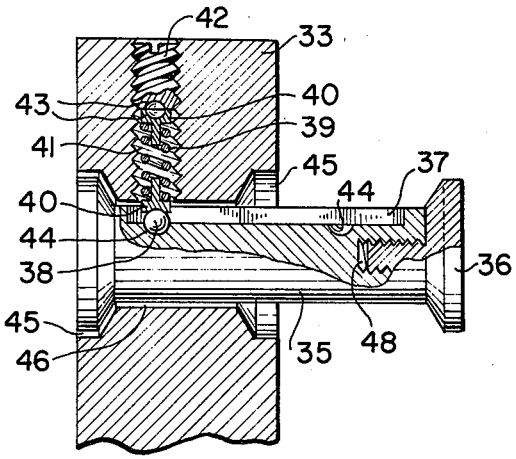
FIG. 26
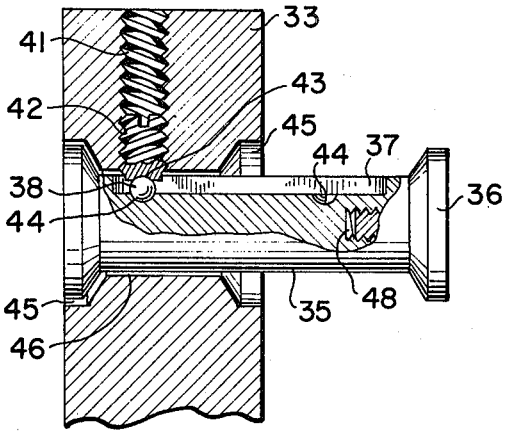
FIG. 27
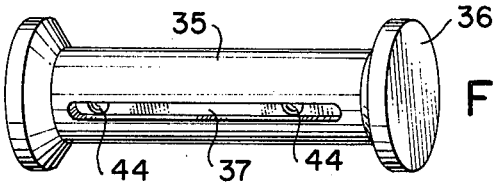
FIG. 28

HAND HELD TOOLS AND UTENSILS STABILIZER BAR, ADJUSTABLE AND NON-ADJUSTABLE

BACKGROUND AND SUMMARY OF THE INVENTION

While spraying my automobile I found my paint spray gun was very difficult to control and aim, for three reasons, first, the weight, a quart of paint that was attached to the paint gun, second, perspiration on my hand, third, the paint gun had a handle which did not allow my hand to grip the handle. The most important part of my hand was not utilized, my thumb.

My invention relates to a stabilizer bar for hand held tools such as paint guns, hand held garden digging, electric lawn trimmer and spraying tools which use a grip type handle. Hand held power drills, power circular saws, hand held jig saws, power chain saws and power sanders, any device which requires a hand held handle or frame.

The position of the stabilizer bar must be correct to insure a positive and comfortable grip, which allows the thumb to grasp the bar under the joint and front portion of the thumb. The object of the different types of stabilizer bars contained in the following drawings is to provide a suitable bar for all size hands and also the many size handles as well. The handles or frames may be light weight or heavy duty, powered or unpowered, high torque or low torque tools.

A better understanding of the invention may be gained by reference to the accompanying drawings in which,

BRIEF DESCRIPTION OF THE DRAWINGS

FIG. 1 is a perspective side view of a handle for a paint gun illustrating the Off-Center mounting of the stabilizer bar;

FIG. 2 is a view similar to that of FIG. 1 illustrating the handle for a paint gun having an On-Center stabilizer bar;

FIG. 3 is a top view of a round, On-Center stabilizer bar;

FIG. 4 is an elevation view of the stabilizer bar of FIG. 3 taken along line 4—4;

FIG. 5 is a top view of the On-Center, elliptical stabilizer bar illustrated in FIG. 2;

FIG. 6 is a side elevation view of the stabilizer bar of FIG. 5 taken along line 6—6;

FIG. 7 is a side elevation view of the stabilizer bar shown in FIG. 5 taken along line 7—7;

FIG. 8 is a top view of the stabilizer bar illustrated in FIG. 1;

FIG. 9 is a side elevation view of the stabilizer bar of FIG. 8 taken along line 9—9;

FIG. 10 is a side elevation view of the stabilizer bar of FIG. 8 taken along line 10—10;

FIG. 11 is a top view of an Off-Center elliptical stabilizer bar for a handle;

FIG. 12 is a side elevation view of the stabilizer bar of FIG. 11 taken along line 12—12;

FIG. 13 is a side elevation view of the stabilizer bar of FIG. 11 taken along line 13—13;

FIG. 14 is a top view of an Off-Center stabilizer bar mounted to a stud molded to the handle;

FIG. 15 is a side elevation view of the stabilizer bar of FIG. 14 taken along line 15—15;

FIG. 16 is a top view of an Off-Center, elliptical stabilizer bar mounted to a stud molded to the handle;

FIG. 17 is a side elevation view of the stabilizer bar of FIG. 16 taken along line 17—17;

FIG. 18 is a side elevation view of the stabilizer bar of FIG. 16 taken along line 18—18;

FIG. 19 is a top view of a stabilizer bar molded to the tool handle;

FIG. 20 is a side elevation view of the stabilizer bar of FIG. 19 taken along line 20—20;

FIG. 21 is a top view of a streamlined stabilizer bar molded to the tool handle;

FIG. 22 is a bottom view of the stabilizer bar of FIG. 21 taken along line 22—22;

FIG. 23 is a rear view of the stabilizer bar of FIG. 21 taken along line 23—23;

FIG. 24 is a side perspective view of a chain saw incorporating a sliding stabilizer bar;

FIG. 25 is an enlarged perspective view of the handle of the chain saw of FIG. 24 illustrating the sliding stabilizer bar;

FIG. 26 is an elevation view of the handle of the chain saw taken along line 26—26 of FIG. 25 and illustrating the sliding stabilizer bar;

FIG. 27 is a view similar to that of FIG. 26 illustrating a further embodiment of the sliding stabilizer bar for the chain saw;

FIG. 28 is a side perspective view of the sliding stabilizer bar; and

FIG. 29 is an enlarged view of the locking device of FIG. 26 used to lock the sliding stabilizer bar in position.

DESCRIPTION

Turning to FIGS. 1–13, certain embodiments of the present invention are shown. A bar 3 extends perpendicular from a handle 1 of a hand-held tool. The bar 3 is long enough to allow the thumb to grasp the bar 3 and has an outer edge 14 providing a ridge to form the outer diameter of the bar 3. The bar 3 is formed to fit the operator's thumb while using the hand held tool which may be powered by a motor, or not powered, a low torque or a high torque tool, lightweight or heavyweight tool. The bar 3, because of its construction and design, when placed on the handle 1 in the proper position in relation to the fingers and thumb, then becomes the stabilizer bar 3 enabling the operator to control, aim and maneuver the tool. When mounted on the right side of the handle 1 it becomes a left hand tool, and when mounted on the left side it becomes a right-hand tool. The stabilizer bar 3 may be made of wood, plastic, rubber or metal, and may be attached by a screw 4 or a bolt. The stabilizer bar 3 may be fully adjustable by means of an off-center bored mounting hole 9 or may be partially adjustable by means of an on-center mounting hole 9, the bar 3 having an oblong or elliptical body center section. In the alternative the bar 3 may be non-adjustable.

Referring specifically to the drawings

FIG. 1 illustrates an "OFF CENTER" mounting hole stabilizer bar 3. The bar 3 is eccentrically and adjustably mounted to the handle 1 of the tool illustrated in the drawings as a paint gun, so that the user's hand 10 may positively grip the handle 1 utilizing the thumb. The bar 3 has the aforementioned flared outer edge 14. The bar mounting hole 9 is bored off center to provide an eccentric motion of the bar 3. As seen in FIG. 9, the hole 9 receives the screw 4 which is threaded into the handle 1. An indexing dot 7 on the top of the bar 3 which is used to calibrate the eccentric rotating 360° movement of the bar. The bar dot indicates where the bar 3 is set in relation to the triangle mark 8 on the handle as the maximum height or extreme point from the center line or mounting screw. The length of the bar and the diameter is determined by the width of the human thumb and allowance for comfort.

Turning to FIGS. 2 and 5–7 is shown a left hand held paint gun with an "ON CENTER" adjustable stabilizer bar 3 having an elliptical body 6 for greater comfort to the user and stability when gripping the handle 1. The handle 1, because of the restricted width from front 11 to rear 12, demands that the stabilizer bar 3 does not extend past the rear 12. Accordingly, the body 6 is elliptical and concave defining ends 20 and has a round outer edge 14 and flared bottom 15. The bar 3 further has a 90° rotating adjustment calibrated by index dot 7 on the top of the bar which indicates the position of the high setting on the handle or frame which has an indexing mark triangle 8. From this position the bar may be rotated 90° forward to adjust to the individual's grip depending on the size of the operators hand.

An alternative to the bar 3 exemplified by FIG. 2, the "Off-Center" or eccentrically mounted bar 3 shown in FIGS. 8–10 may be used. The bar 3 has a narrow base 29, a cylindrical body 13 and a flared outer edge 14. The hole 9, as seen in FIG. 9, has an 82° recess 50 so that the screw 4 may be received by the hole 9 and threaded into the handle 1. An index dot 7 is provided on the top of the bar 3 so that the eccentric motion of the bar 3 with respect to a marked triangle 8 may be determined. Viewing FIGS. 3 and 4 is illustrated an "ON CENTER" center line non-adjustable round stabilizer bar. This bar 3 must be installed at a position on the handle of a paint gun which would restrict the operators size of hand, hence three sizes would be manufactured, small, medium and large hand grips. The bar 3 has a concave body 5, a radius outer edge 14 and bottom edge 15. The length of the bar, the outside diameter and contour is designed for human hand comfort.

FIG. 11 is an "OFF CENTER" medium torque adjustable bar 3 having an elliptical shape body 28 is shown. The 90° adjustable indexing stabilizer bar 3 has a flared outer edge 14 and a straight base 29. Due to the elliptical body 28, ends 27 are defined. The "Off-Center" mounting hole 9 has an 82° recess 50 which accommodates the mounting screw 4 to adjustably secure the bar 3 to the handle 1.

Turning to FIGS. 14–18, a further embodiment of the invention is shown. The handle 1 of the tool may be provided with a mounting stud 31 molded to the handle 1 at a position on the tool which will allow a right hand operator to grip a mating round concave stabilizer bar 3 in a comfortable grip. The bar 3 has a concave body 5 and has an off-center bore 17 extending from the bottom edge 15 to have a terminus defining a locking surface 18. A round head screw 19 tightens the locking surface 18 against the top of the stud 31 so as to allow a 360° rotating adjustment of the bar 3.

Turning to FIGS. 14 and 15 an "OFF CENTER" 360° adjustable high torque power tool handle or frame with the stabilizer mounting stud 31 molded into the handle for greater strength. The 360° adjustable bar 3 is mounted to the stud 31 and has a round concave body 5, a radius upper edge 14 and a round radius bottom edge 15. Two inside holes, a small diameter top hole 16 and a larger diameter hole 17 lie on the same center line. The larger hole 17 will accept the stud 31 while the smaller hole 16 accepts the locking screw 19. The locking surface 18 is at the terminus of the large hole 17 and creates a shoulder to allow the bar 3 to be rotated and locked in any position to fit the hand. A lock washer or shake-proof washer may be used under the locking screw head for this purpose. It is to be noted that the depth of the large hole 17 is calculated to allow a clearance area between the stabilizer bar 3 and the handle 1 of the tool. When the bar 3 is in the proper position, the locking screw 19 is tightened creating pressure against the top of the bar 3 which in turn forces the locking surface 18 to lock on top of the stud 31 thus locking the bar 3. The stud 31 is machined to a working fit to accept the large bore hole 17 in the bar 3. The eccentric rotation of the bar 3 is indexed by the indexing dot 7 shown opposite the triangle mark 8 on the handle. The mounting stud is designed to accept the large and small inside diameters of the adjustable stabilizer bar. The mounting stud may be round, gear form or hexagon.

FIG. 16 is a top view of an "OFF CENTER" 90° adjustable high torque power tool stabilizer bar that will accept a round diameter mounting stud 31 that is molded into the handle. The 90° adjustable bar 3 has an elliptical and concave body as shown at 20 and 25. As stated above, the mounting stud 31 may have a round, hexagon or gear-type spline outline diameter to allow the stabilizer bar 3 having a like shape to lock into a comfortable hand-gripping position when rotated in relation to the hand grip. The increments or gear segment stud determines the position of the bar when rotated in relation to the hand grip. The mounting screw and lock washer then secures the bar 3 to the handle 1. When vibration is a factor the outside diameter and shape of the mounting stud 31 molded into the handle 1 and the inside mating mounting hole 17 in the bar 3 may vary in order to create a firm locking position. Additionally the top of the stud may have a spline or groove surface. The elongated stabilizer bar with radius ends, indexing dot and minus a mounting screw is clearly illustrated.

Turning to FIGS. 19 and 20 there is shown a non-adjustable stabilizer bar 32 that is molded at the proper position of the tool handle 1 and is tapered so as to allow the mold release needed to form the handle and bar.

FIGS. 21–22 illustrate a streamline stabilizer bar molded into the handle 1 or frame of a hand held tool when a high torque non adjustable bar is needed. The tear drop illustrated is one of several shapes that may be designed to enhance the product frame which may be made of wood, plastic or metal.

The tear drop shape stabilizer bar molded into the handle 1 has a radius leading edge 22, top radius 24 and a trailing edge radius 23. The slightly tapered and rounded leading edge 22, rounded top 24 and narrow tapered trailing edge 23 are curved to form a radius fillet bottom 30. FIG. 23 illustrates the extended height of the bar that is necessary because of the width of the thumb and the bar thickness or width which must be tapered to allow the mold to release the bar.

Turning to FIGS. 24–29 is shown a quick change sliding or telescoping stabilizer bar 35. It is designed for a chain saw and other high torque tools. As a situation may arise where a man in a tree cutting off a branch high in that tree, may have to shift hands, from left to right in order to keep a good foot hold in the tree. The stabilizer bar 35 is shown in the left-hand position in the handle 33 of the chain saw 47. The bar 35 is placed in the saw handle 33 at a position that will allow the thumb to grasp the bar 35 by the left or right hand. A bored hole 46 is a working fit for the bar 35, the bore having cavities 45 on each side designed to accept the end piece 36 of the bar 35 when it becomes either a right or left-hand saw stabilizer. The bar 35 has a threaded hole 48 to lock the end piece 36 into place.

The bar 35 has a ball slot 37 with ball recesses 44 on each end of the slot 37. To lock the bar 35 in either the right or left-hand position, the locking device as best shown in FIG. 29 is employed. The device is positioned at a 45° angle of the handle center line so as not to discomfort or interfere with the thumb grip. A locking device includes a spring loaded ball 38, two spring guides 40, and spring 39 which are slip fit into a threaded hole 41. A locking screw 42 threads into the threaded hole 41 and is tightened to allow the spring 39 to compress. This maneuver provides the correct pressure on the ball 38 through the spring guides 40 and spring 39 which forces the ball 38 into the ball slot 37. When the bar 35 is bottomed or pushed to the proper side, the ball 38 is forced into the ball recesses 44. The bar 35 is then locked by the ball 38 until reverse pressure is applied to the opposite side of the bar 35. The pressure must be great enough to force the spring 38 to compress thus allowing the ball 38 to leave the ball recess 44. To become a right-hand stabilizer bar, the bar 35 is pushed inward on the right side forming the spring 39 to compress to allow the ball 38 to emerge from the ball recess 44 and travel to the opposite side where it is locked by the other ball recess 44. The end piece 36 enters the handle cavity 45 thus acting as a stop in the handle. Accordingly, the sliding stabilizer bar would allow him to change from left to right hand by pressing the right outside end of the extended bar which forces the locking ball bearing to leave its' recessed ball stop in the bar body and then lock in the opposite recessed ball stop when the bar is bottomed hence the end pieces act as a stop for this maneuver. When it is necessary the novel stabilizer bar may also be made into a permanent left or right hand bar, as shown in FIG. 27, by removing the spring assembly and using a ball bearing and set screw to lock the ball in the recessed locking bar.

By way of illustration, FIG. 29 shows the spring loaded locking device of FIG. 25 assembled to illustrate the working parts. The ball bearing may be silver soldered into the spring guide or it may be a press fit into the spring guide whose inside diameter extends past the ball center line which in turn will accept the ball to become a press fit. The free ball locking device illustrated FIG. 29 is used on small size chain saws.

While I have described the invention along specific lines, various minor changes and refinement may be made therein without departing from it's principle, and I reserve the right to employ all such changes and refinements as may fall within the scope and spirit of the appended claims.

I claim:

1. In a handle for a hand tool, to be grasped by one hand of a user, the improvement comprising:

a stabilizer bar secured to said handle and extending laterally from a side wall thereof for engagement by the thumb of the hand of the user, said stabilizing bar having a base portion adjacent the handle, a body portion having a length substantially equal to the width of the user's thumb at the knuckle thereof to receive and mate with the user's thumb to provide a stable grip for the tool, and an end surface remote from the handle.

2. The handle of claim 1 wherein said body is cylindrical and has an axis which extends laterally from said side wall.

3. The handle described in claim 2 wherein said end surface has an outer edge of greater diameter than said body.

4. The handle of claim 2 wherein said bar is adjustably secured to said handle to pivot eccentrically about its axis to adjust the position of said body.

5. The handle of claim 4 further including means for indexing the position of said body on said handle.

6. The handle of claim 1 wherein said body is generally cylindrical having a concave periphery to receive the user's thumb, the axis of said body extending laterally from said side wall.

7. In a handle for a hand tool, the improvement comprising:

a stabilizer bar disposed in said handle, said bar being slidable through said handle from a first position extending out on the left side for engagement by the thumb of the right hand to a second position extending out on the right side for engagement by the thumb of the left hand; and means for securing said stabilizer bar in said handle in both of said first and second positions.

8. The handle of claim 7 wherein said stabilizer bar has a pair of cavities and said securing means includes a ball receivable by one of said cavities when said bar is in said first and the other of said cavities when said bar is in said second position and means for maintaining said ball-cavity engagement.

9. The handle of claim 7 wherein said bar has ends adapted to stop the sliding of said bar through at the first and second positions.

10. The handle of claim 9 wherein said handle has recesses to receive said ends of said bar when in said first and said second positions.

11. The handle of claim 8 wherein said means for maintaining said ball-cavity engagement is a spring urging said ball into said cavity.

12. The handle of claim 8 wherein said means for monitoring ball-cavity engagement is a screw to trap said ball in said cavity.

13. In a handle for a hand tool to be grasped by the hand of the user, the improvement comprising:

a stabilizer bar secured to said handle and extending laterally from a side wall thereof for engagement by the thumb of the hand of the user, said stabilizer bar having a base portion adjacent the handle, an elliptical body portion having a concave periphery to receive the user's thumb and an end remote from said handle.

14. The handle described in claim 13 wherein said bar is adjustably secured to said handle to adjust the position of said body of said bar.

15. The handle described in claim 13 wherein said bar is eccentrically and adjustably secured to said handle to adjust the position of said body of said bar.

* * * * *